US007367278B2

(12) United States Patent
Tande et al.

(10) Patent No.: US 7,367,278 B2
(45) Date of Patent: May 6, 2008

(54) DEVICE OF A TOWING PIN FOR GUIDING A CABLE ON BOARD A VESSEL

(75) Inventors: Arne Tande, Brattvag (NO); Ludvig Kare Oyen, Valderoy (NO); Ottar Antonsen, Sovik (NO)

(73) Assignee: Rolls-Royce Marine AS, Brattvaag (NO)

( * ) Notice: Subject to any disclaimer, the term of this patent is extended or adjusted under 35 U.S.C. 154(b) by 0 days.

(21) Appl. No.: 10/543,305

(22) PCT Filed: Jan. 26, 2005

(86) PCT No.: PCT/NO2005/000030

§ 371 (c)(1),
(2), (4) Date: Sep. 5, 2006

(87) PCT Pub. No.: WO2005/070754

PCT Pub. Date: Aug. 4, 2005

(65) Prior Publication Data

US 2007/0069540 A1 Mar. 29, 2007

(30) Foreign Application Priority Data

Jan. 26, 2004 (NO) ..... 20040355

(51) Int. Cl.
*B63B 21/08* (2006.01)

(52) U.S. Cl. ..... 114/199; 114/218

(58) Field of Classification Search ..... 114/218, 114/199

See application file for complete search history.

(56) References Cited

U.S. PATENT DOCUMENTS 3,771,488 A * 11/1973 Ecke ..... 114/218
4,278,041 A * 7/1981 Williams ..... 114/210
4,347,800 A * 9/1982 Culver ..... 114/218
4,423,697 A * 1/1984 Royset ..... 114/199
4,603,649 A * 8/1986 Hystad ..... 114/199

* cited by examiner

*Primary Examiner*—Stephen Avila
(74) *Attorney, Agent, or Firm*—Sterne, Kessler, Goldstein & Fox P.L.L.C.

(57) ABSTRACT

Device for a tow pin to lead a cable, such as a chain, wire, hawser, etc., onboard a vessel, comprising a number of cylinders that can be hoisted and lowered, where each of the cylinders comprises a rotary stopping element, facing each other, to prevent that the cable runs out of the tow pin. Said stopping element can be turned outwards with the help of a piston arrangement arranged in the cylinder, and that the stopping element can be turned outwards in the whole of the working area of the tow pin.

4 Claims, 4 Drawing Sheets

DEVICE OF A TOWING PIN FOR GUIDING A CABLE ON BOARD A VESSEL

The present invention relates to a device for a tow pin to lead a cable, such as a chain, wire, hawser, etc., onboard a vessel, comprising a number of cylinders that can be hoisted and lowered, where each of the cylinders comprises a rotary stopping element, facing each other, to prevent that the cable runs out of the tow pin.

The object of the invention is to provide tow pins which satisfy existing requirements of Norwegian Offshore Sector in that the tow pin shall resist 60 degrees force to one side and 30 degrees force upwards. With force is here meant the maximum tugging power (Bollard Pull) of the ship.

It is a further object to provide tow pins that are active tools during anchor handling in anchorage by Offshore installation and also for tugboats and in other tugging applications.

The advantage of the present invention is, among other things, that the stopping elements according to the invention, which lock-in the mooring components, can be driven into and out of position independently of the height position of the tow pin. When the tow pins are driven up or down, the stopping elements can stand in a closed working position so that the mooring appliance can not come out by accident. By using powerful cylinders to hoist/lower the tow pins, a unique advantage is achieved; namely that the mooring appliance can be pulled down to shark jaws, to other appliances or to the deck with considerable power. Today, this is carried out by high risk rigging of wire from a support winch, something which results in personnel operating in an unsafe area.

The form of the stopping elements can be such that the mooring appliances are centred so that when they come down, they are located in the centre of the shark jaw. That the stopping elements can be retracted in the tow pins independently of the height of the tow pins, has the considerable advantage that the tow pins are smooth, without protuberances on the top. Then, one avoids the dangerous situations that arise with other solutions for tow pins: Straps and mooring components that are delivered from above by a platform crane are easily wound round the top plates of the tow pins and dangerous jerks, wire breakages and shackles, etc., which are thrown through the air can arise. By retracting the tow pins unevenly, the stopping elements will be able to twist the chain links so that they fit easily down in the shark jaw.

An essential advantage of the present invention is that there are no recesses in the deck around the base of the tow pins. Such recesses exist on known tow pins to give room for the protuberances they have on the top. But these recesses are often filled with mud, sand, shells, etc., that are brought up onto the deck with the mooring appliance and anchor. Thereby, the tow pins can not be lowered all the way down without the crew first cleaning the recesses. In addition, the mooring appliances, especially wires and fibre-hawsers, wear against the edges of the recesses resulting in expensive damages.

According to the present invention a tow pin is provided comprising, for example, through-going, load-carrying pipes in cast steel, and hydraulic cylinders that are powerful enough not only to lift the tow pins in position, but also to pull down the mooring appliances which are under great strain.

A roller, which rotates easily and which has large resistance to wear and deformation, can stand outside the main pipe according to the invention. This covers the working height that is defined as the height of a line between the stern roller of the ship and the uppermost point of the winch drum. The stopping elements can withstand large loads upwards and satisfy the requirement of 30 degrees upwards displacement by the Bollard pull of the ship. The stopping elements can be turned to a hidden position inside the main pipe so that they are completely out of the way of the mooring appliances that move along the tow pins.

The stopping elements can be operated with specially constructed hydraulic cylinders that are self-adjusting because they are mounted on a ball. A bellows protects the mounting against sand and water.

The tow pins can have a smooth top surface without boltholes etc., this so that the anchors shall glide across without getting stuck. There are no recesses in the deck, and the mooring appliances are thereby subjected to a gentle treatment.

A roller can easily be fitted behind the tow pins without tools, this prevents the wire climbing up the tow pin during rewinding from winch to winch via the tow pin.

According to the invention the above mentioned objects are achieved with a device which is characterised by the independent claim 1. The device of a tow pin to lead a cable, such a chain, wire, hawser, etc., onboard a vessel, comprises a number of cylinders that can be hoisted and lowered, where each of the cylinders comprises a rotary stopping element, facing each other, to prevent that the cable runs out of the tow pin. The stopping element can be turned outwards with the help of a piston arrangement arranged in the cylinder, and the stopping element can be turned out in the whole of the tow pin working area.

The tow pin can be designed as an active tow pin in that the cylinders are arranged to be separately, sufficiently driven up to bring down a cable, at the same time as the stopping elements are adapted for said turnable movement independently of each other.

Each cylinder can comprise a pressure body for said hoisting and lowering, and the piston arrangement is arranged in the cylinder for the out-swinging of the stopping element. The stopping element can comprise a sideways, outwardly extending, side surface arranged to lie against a support/stopping surface in the cylinder.

The invention shall now be described in more detail with reference to the enclosed figures in which.

The enclosed figures show a tow pin according to the invention which comprises two cylinders 12, 14 that can be hoisted and lowered, and which are arranged in their own recesses in the deck 16 of a ship. The cylinders comprise their own pressure body 18*a*, 18*b*, such as a hydraulic cylinder/piston arrangement.

Figure 1:
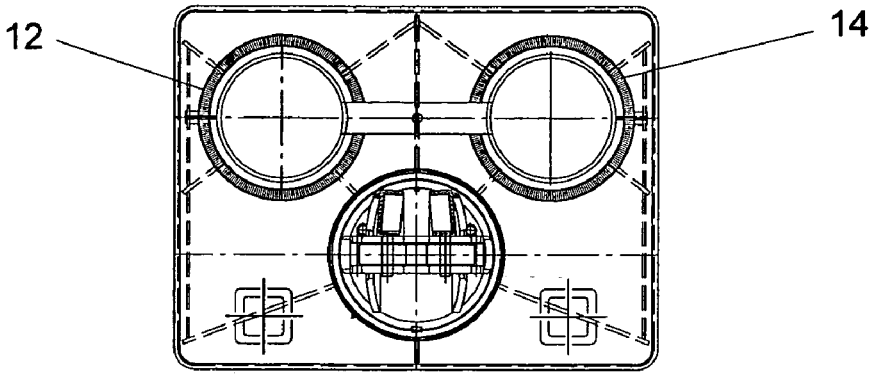
FIG. 1 shows a cylinder arrangement of a tow pin according to the invention, viewed from above.
Figure 4:
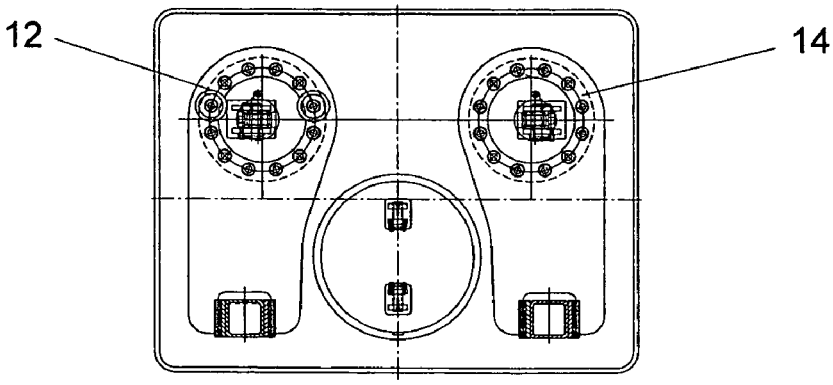
FIG. 4 shows a tow pin arrangement according to the invention.
Figure 2:
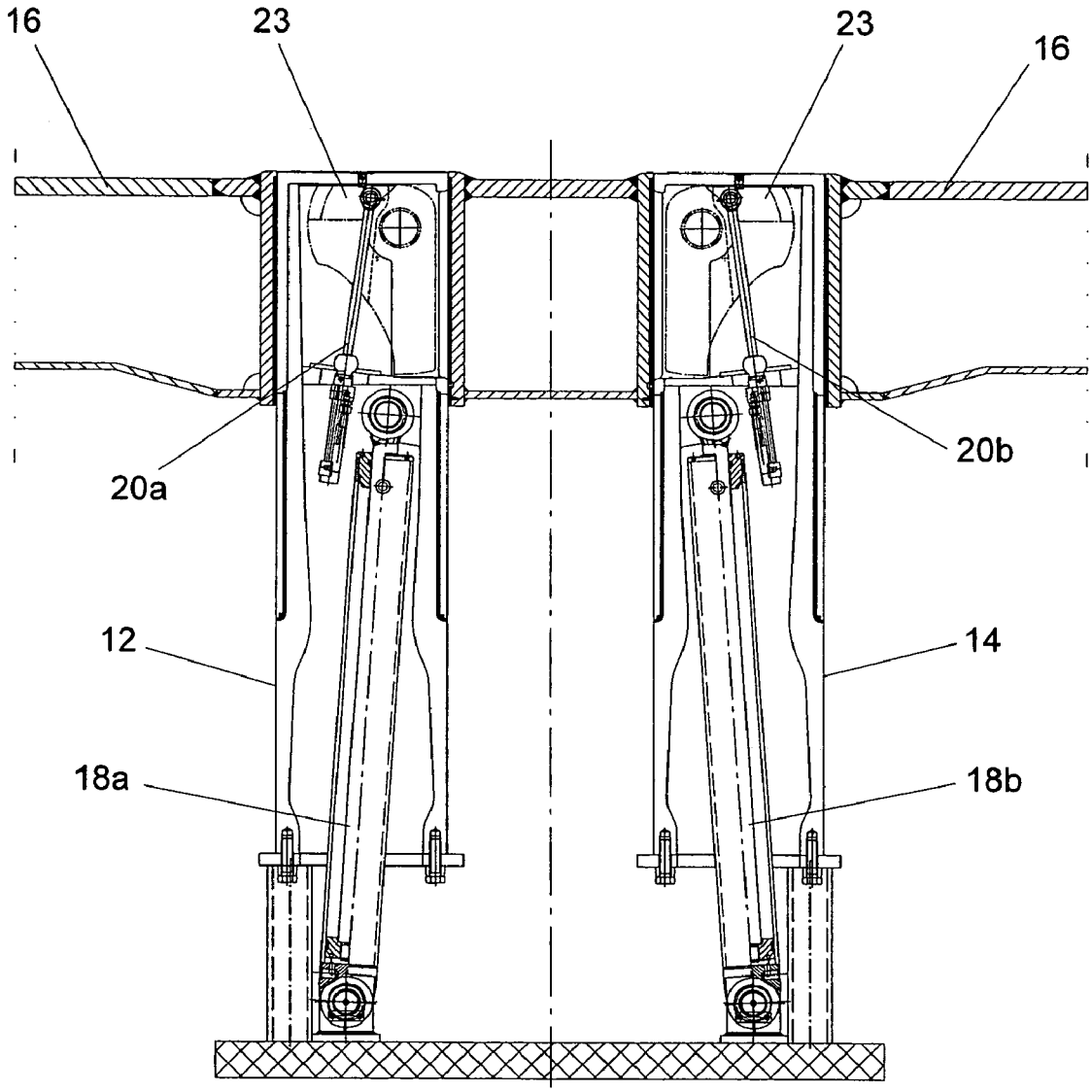
FIG. 2 shows a partial section of a tow pin according to the invention in retracted position.
Figure 3:
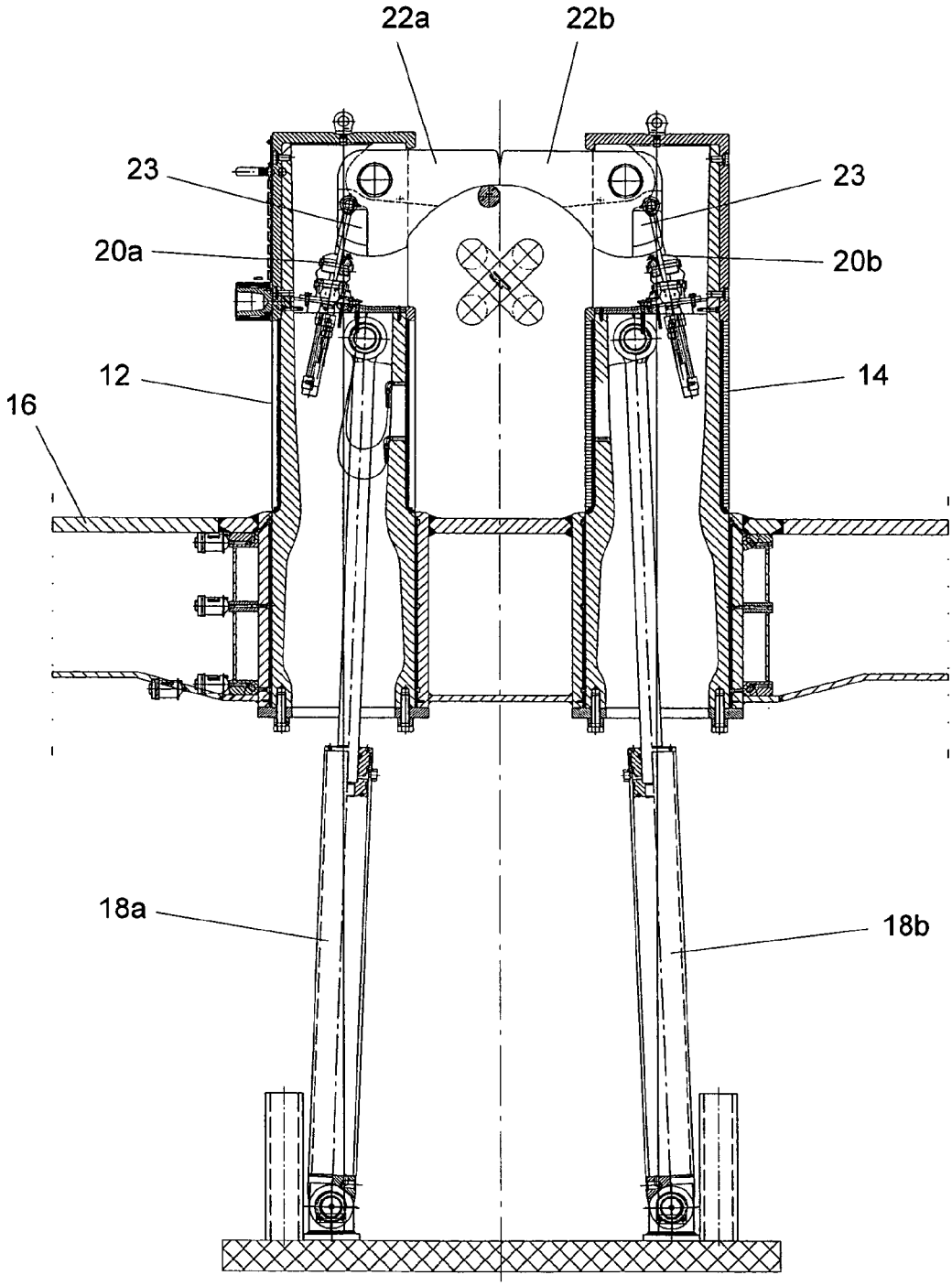
FIG. 3 shows a partial section of a tow pin according to the invention in raised position.
Figure 5:
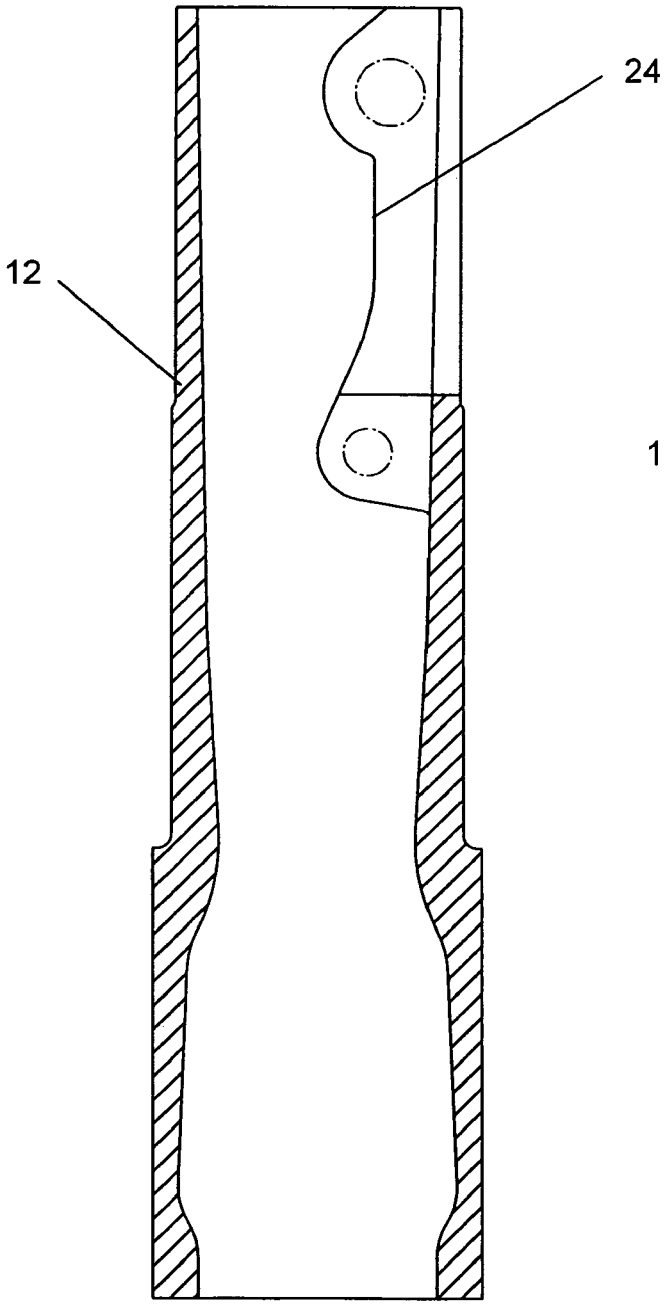
FIG. 5 shows a section of a cylinder for use in the tow pin according to the invention.
Figure 6:
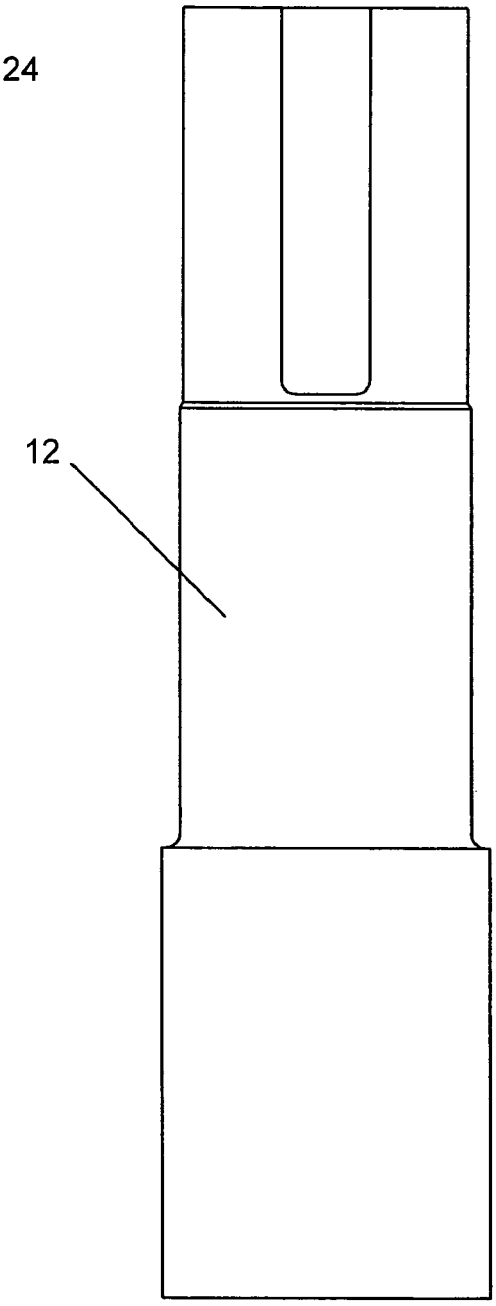
FIG. 6 shows a cylinder for use in the tow pin according to the invention.

FIG. 2 shows the tow pin retracted in the deck 16, while FIG. 3 shows the tow pin in its upper working position, i.e. completely extended. As the figures show, the pressure bodies 18*a*, 18*b*, can be used for this hoisting and lowering movement. Furthermore, each cylinder comprises a stopping element 22*a,* 22*b* that can swing outwards, and which can preferably be turned about a horizontal axis. The two cylinders are placed so that when the stopping elements are in a fully swung out position, their swung out ends approximately touch each other, or lie against each other, so that an inner room is provided between the cylinders and stopping elements, where the cable lies.

The stopping elements are mounted on a horizontal shaft and can swing outwards with the help of their own cylinder arrangement 20*a,* 20*b.* The cylinder arrangement is consequently arranged inside the cylinder and functions as a pushing element or pulling element to turn the stopping element around the shaft. The cylinder arrangement can comprise a ball bearing for control of the power transmission from the cylinder to the stopping element, and the ball bearing with associated components is protected by a surrounding lining or bellows.

The stopping element 22*a,* 22*b* preferably comprises a sideways, outwardly extending, side surface 23 that pushes against an inner stopping/support surface 24 in the cylinder, to better take up the forces that are imposed onto the stopping elements. The cylinder arrangement can also lock the side surfaces of the stopping element against said stop surface 24 in the cylinder.

Thus, the invention relates to a device for a tow pin to lead a cable, such as a chain, wire, hawser, etc., onboard a vessel, comprising a number of cylinders 12, 14 that can be hoisted and lowered, where each of the cylinders comprises a rotary stopping element 22*a,* 22*b,* facing each other, to prevent that the cable runs out of the tow pin, said stopping element 22*a,* 22*b* can swing outwards with the help of a piston arrangement 20*a,* 20*b* arranged in the cylinder 12, 14, and that the stopping element 20*a,* 20*b* can swing outwards in the whole of the working area of the tow pin.

Furthermore, the tow pin is designed as an active tow pin in that the cylinders 12, 14 are arranged to be separately, sufficiently driven up to bring down a cable, at the same time as the stopping elements 22*a,* 22*b* are set up for said out-swinging movement independently of each other.

Each cylinder 12, 14 comprises, as mentioned, a pressure body 18*a,* 18*b* for said hoisting and lowering, and the piston arrangement 20*a,* 20*b* for out-swinging of the stopping elements is arranged in the cylinder, and the stopping element comprises a sideways, outwardly extending, side surface set up to lie against a support/stopping surface in the cylinder.

The invention claimed is:

1. A tow pin for guiding a cable onboard a vessel, the tow pin comprising:

two cylinders independently moveable between raised and lowered positions by a first pair of separate hydraulic piston arrangements, and each cylinder including a rotary stopping element pivotable about a horizontal axis, the stopping elements of the cylinders are mounted on a horizontal shaft and adapted to be pivotable about said horizontal axis, to a position in which they are facing one another to prevent a cable running out of the tow pin, and to be driven into and out of position independent of the height position of the tow pin, by a second pair of separate hydraulic piston arrangements located within the associated cylinder, and each stopping element being turnable and lockable by said second pair of hydraulic piston arrangements, throughout a working range of movement of the associated cylinder of the tow pin, and each stopping element comprises a sideways, outwardly extending side surface engaging an inner stopping/support surface in the cylinder to take up forces imposed on the stopping elements.

2. A tow pin according to claim 1, wherein the tow pin is an active tow pin, the cylinders being arranged to be driven independently sufficient to bring down a cable, in use, the stopping elements being arranged to be turned independently of one another.

3. A tow pin according to claim 1, wherein each cylinder comprises a pressure body for movement between said raised and lowered positions, and the piston arrangement is located within the associated cylinder.

4. A tow pin according to claim 1, wherein each stopping element includes a sideways, outwardly extending side surface arranged to lie against a stopping surface of the cylinder, in use.

* * * * *